US011273952B1

(12) United States Patent
Lane

(10) Patent No.: US 11,273,952 B1
(45) Date of Patent: Mar. 15, 2022

(54) SAFELY SIP TM ANTI-CUT SEAL

(71) Applicant: Jared Cory Lane, Piffard, NY (US)

(72) Inventor: Jared Cory Lane, Piffard, NY (US)

( * ) Notice: Subject to any disclaimer, the term of this patent is extended or adjusted under 35 U.S.C. 154(b) by 72 days.

(21) Appl. No.: 16/682,341

(22) Filed: Jan. 8, 2020

Related U.S. Application Data

(60) Provisional application No. 62/766,997, filed on Nov. 15, 2018.

(51) Int. Cl.
*B65D 17/28* (2006.01)

(52) U.S. Cl.
CPC .. *B65D 17/4012* (2018.01); *B65D 2517/0077* (2013.01)

(58) Field of Classification Search
CPC ..... B65D 17/4012; B65D 2517/0077
USPC ..... 220/269
See application file for complete search history.

(56) References Cited

U.S. PATENT DOCUMENTS 3,021,976 A * 2/1962 Tracy ..... B65D 47/141 220/619
3,744,662 A * 7/1973 Zundel ..... B65D 17/506 220/269
3,871,552 A * 3/1975 Irland ..... B65D 17/4012 222/83
4,016,311 A * 4/1977 Ellerbrock ..... B65D 17/4011 427/287
4,526,287 A * 7/1985 Miyamatsu ..... B29C 63/0082 220/260
4,781,303 A * 11/1988 Wells ..... B65D 17/4012 220/269
5,743,445 A * 4/1998 Benarrouch ..... B65D 17/4012 222/541.9
2007/0068943 A1* 3/2007 Ramsey ..... B65D 17/506 220/254.3
2013/0020326 A1* 1/2013 Thielen ..... B21D 51/383 220/270
2013/0270267 A1* 10/2013 Ramsey ..... B65D 17/502 220/212
2018/0229901 A1* 8/2018 Monica ..... B65D 17/4012

* cited by examiner

*Primary Examiner* — J. Gregory Pickett
*Assistant Examiner* — Niki M Eloshway
(74) *Attorney, Agent, or Firm* — Woods Oviatt Gilman LLP; Dennis B. Danella, Esq.

(57) ABSTRACT

A safety seal for use with a container is described. The container includes a top lid having a channel defined around a portion of a scored flap. A pull-tab engages the flap and enables opening of the flap and creating an open lip within the top lid. The safety seal is an arcuate seal member received within the arcuate channel to seal the container interior volume. The arcuate seal member is C-shaped and has a top surface and a bottom surface defining a first thickness, and a first edge and a second edge defining a first width. The first edge defines a first channel that receives a portion of the top lid therein. The second edge defines a second channel that receives a portion of the flap therein. Also, one or both of the top surface and bottom surface may include a respective furrow defined therein.

5 Claims, 5 Drawing Sheets

SAFELY SIP TM ANTI-CUT SEAL

FIELD OF THE INVENTION

The present invention relates to beverage cans; in particular, an aluminum pull-tab can; and more particularly to a safety seal for use within an aluminum pull-tab beverage can.

BACKGROUND OF THE INVENTION

Aluminum cans have become ubiquitous containers for any number of consumer goods, including fruits, vegetables, sauces and beverages. A subset of aluminum cans includes pull-tab beverage containers for such beverages as soda pop, juice, beer and the like. As their name implies, pull-tab cans include a pivoting pull-tab that is configured to engage a scored flap within the can's lid. Pressure from the pull-tab causes the scored flap to rupture, whereby continued application of pressure serves to push the flap within the container's internal void. Fluid within the container may then be poured through the opening created by this displacement of the flap. However, as the flap is merely scored within the lid of the can, its rupture results in an opening have a sharp meal edge. This sharp edge may lead to cuts to a user's fingers, lips or tongue.

Therefore, there is a need for a safety seal for use with aluminum beverage containers to prevent cuts to users. The present invention addresses these as well as other needs.

BRIEF SUMMARY OF THE INVENTION

It is, therefore, an aspect of the present invention to provide a safety seal configured for use with a container. The container defines an interior volume and includes a top lid having a channel defined around a portion of a scored flap, and a pull-tab adapted to engage the flap and enable opening of the flap and creating an open lip within the top lid thereby providing access to the interior volume. The safety seal comprises an arcuate seal member dimensioned to be received within the arcuate channel to thereby seal the container interior volume. The arcuate seal member may be C-shaped, having a top surface and a bottom surface defining a first thickness, and a first edge and a second edge defining a first width. The first edge defines a first channel configured to receive a portion of the top lid therein, and the second edge defines a second channel configured to receive a portion of the flap therein.

In a further aspect of the present invention, one or both of the top surface and bottom surface include a respective furrow defined therein.

In another aspect, the present invention may provide for a beverage container comprising a closed bottom, a continuous sidewall and a top lid, all defining a container interior volume. The top lid includes an arcuate channel defined therein and a scored flap in communication with the arcuate channel. An arcuate seal member is dimensioned to be received within the arcuate channel to thereby seal the container interior volume. A pull-tab is mounted on the top lid proximate the scored flap and is adapted to engage the flap to create an open lip within the top lid. This provides access to the container interior volume while the arcuate seal member surrounds the open lip.

In still another aspect of the present invention, the arcuate seal member is C-shaped and has a top surface and a bottom surface defining a first thickness and a first edge and a second edge defining a first width. The first edge may also define a first channel configured to receive a portion of the top lid therein, and the second edge may define a second channel configured to receive a portion of the flap therein. One or both of the top surface and the bottom surface may also include a respective furrow defined therein. In one aspect, the arcuate seal member comprises a resilient yet flexible material.

Additional aspects, advantages and novel features of the present invention will be set forth in part in the description which follows, and will in part become apparent to those in the practice of the invention, when considered with the attached figures.

BRIEF DESCRIPTION OF THE DRAWINGS

The accompanying drawings form a part of this specification and are to be read in conjunction therewith, wherein like reference numerals are employed to indicate like parts in the various views, and wherein.

DETAILED DESCRIPTION OF THE INVENTION

Figure 1:
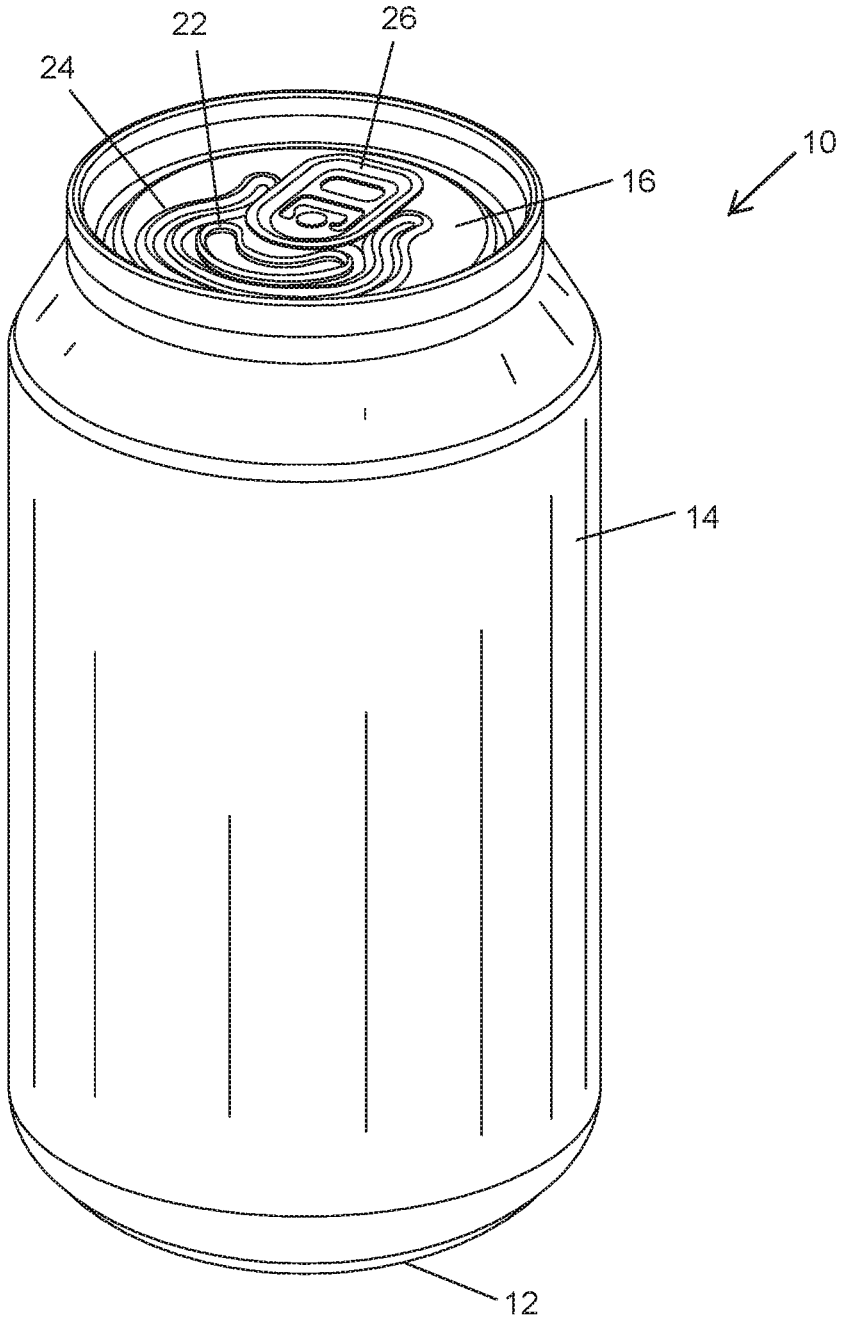
FIG. 1 is a perspective view of a beverage container including an embodiment of a safety seal in accordance with an aspect of the present invention.
Figure 2:
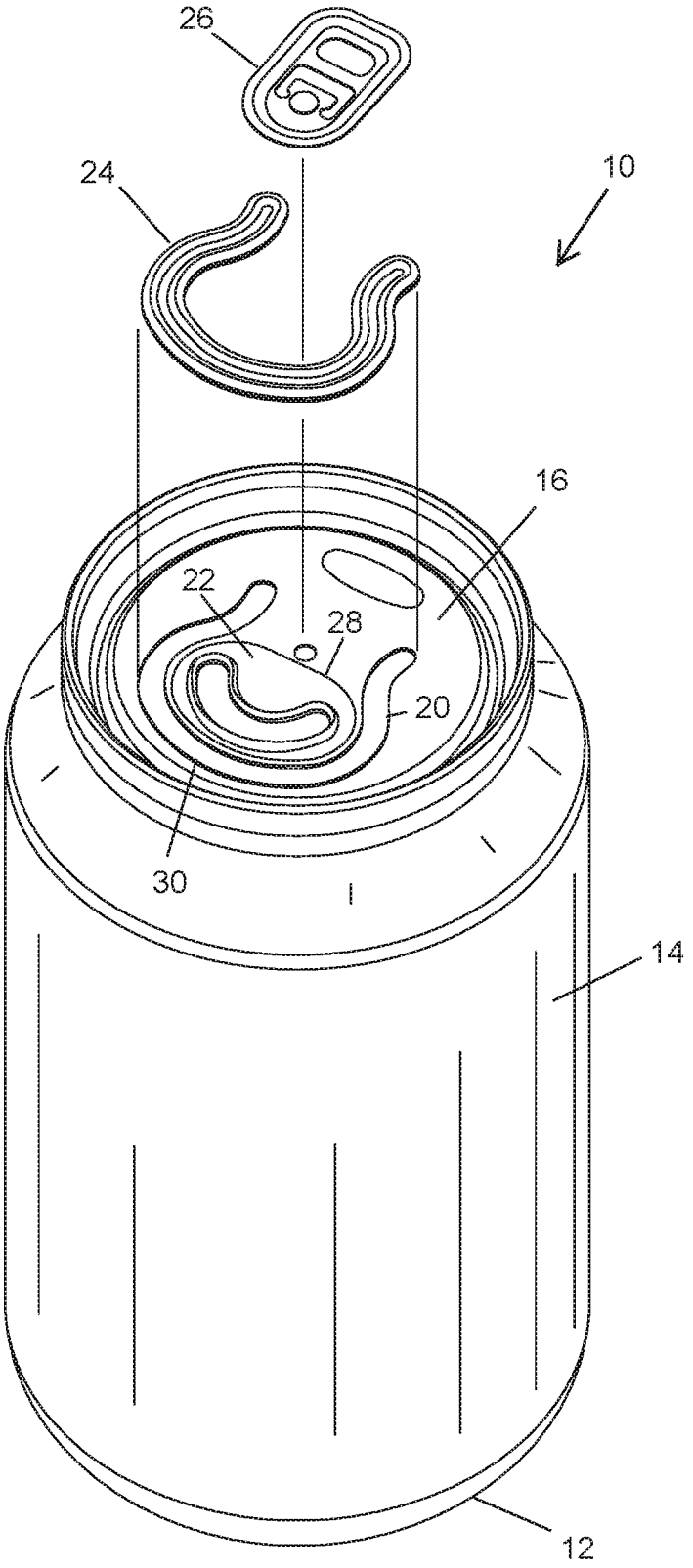
FIG. 2 is an exploded view of the beverage container and safety seal shown in FIG. 1.
Figure 3:
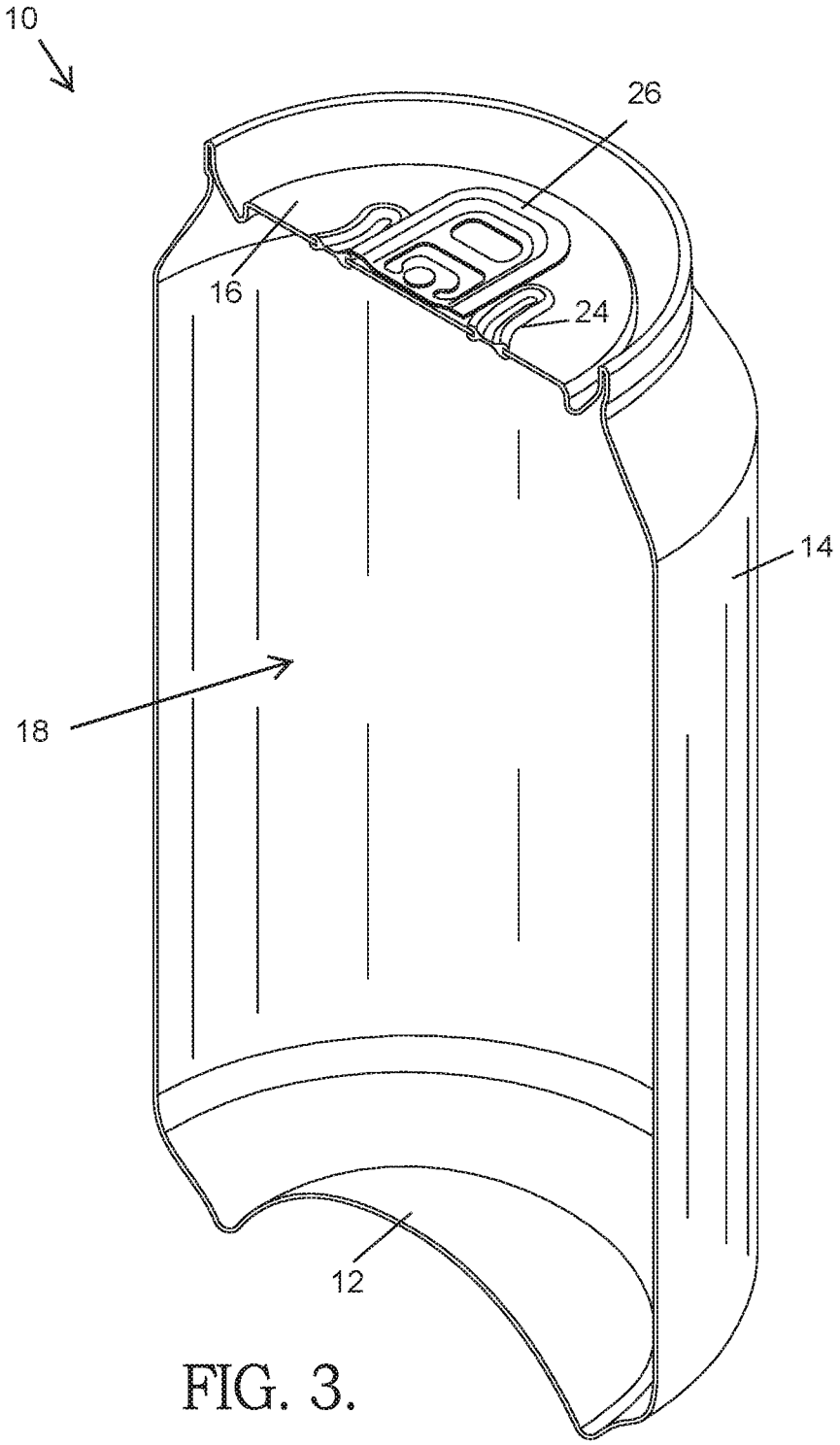
FIG. 3 is a longitudinal cross section view of the beverage container and safety seal shown in FIG. 1.
Figure 4:
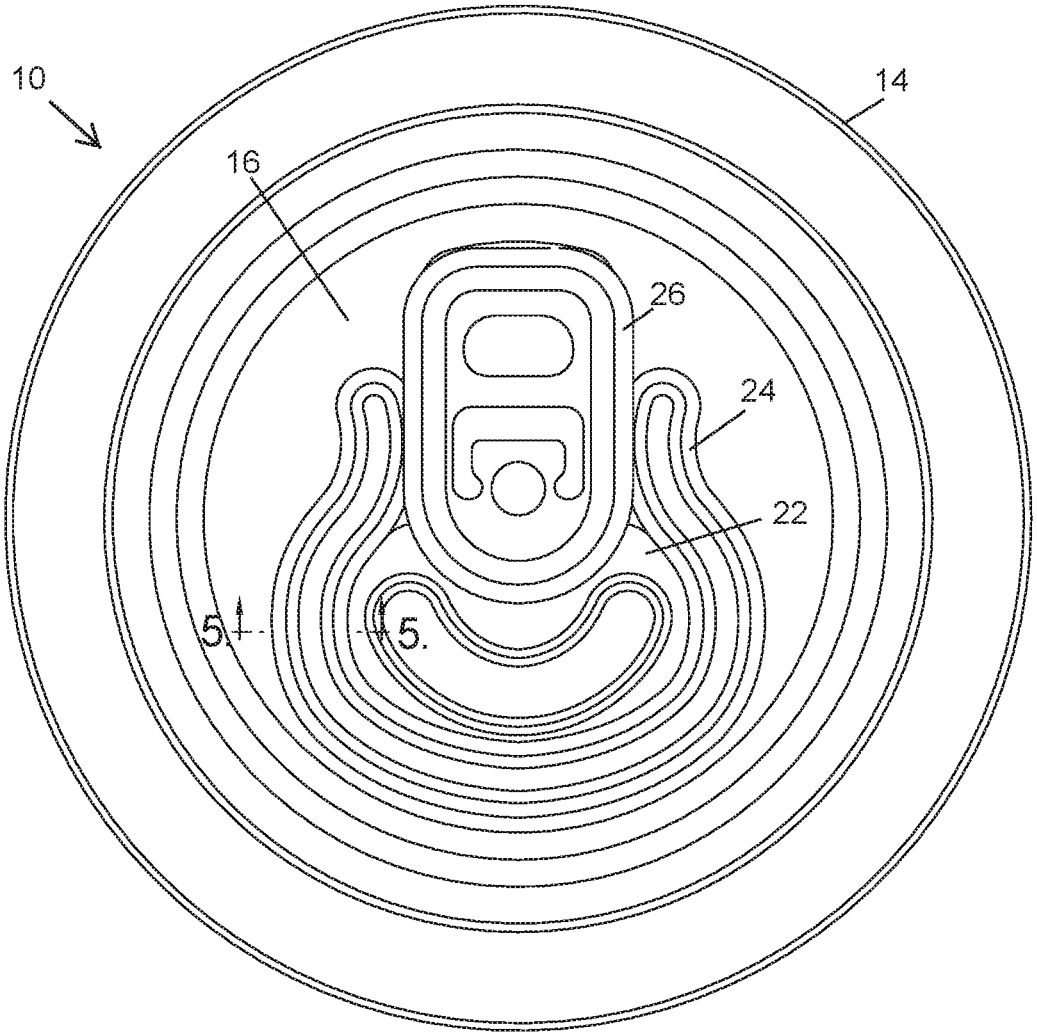
FIG. 4 is a top plan view of the beverage container and safety seal shown in FIG. 1.
Figure 6:
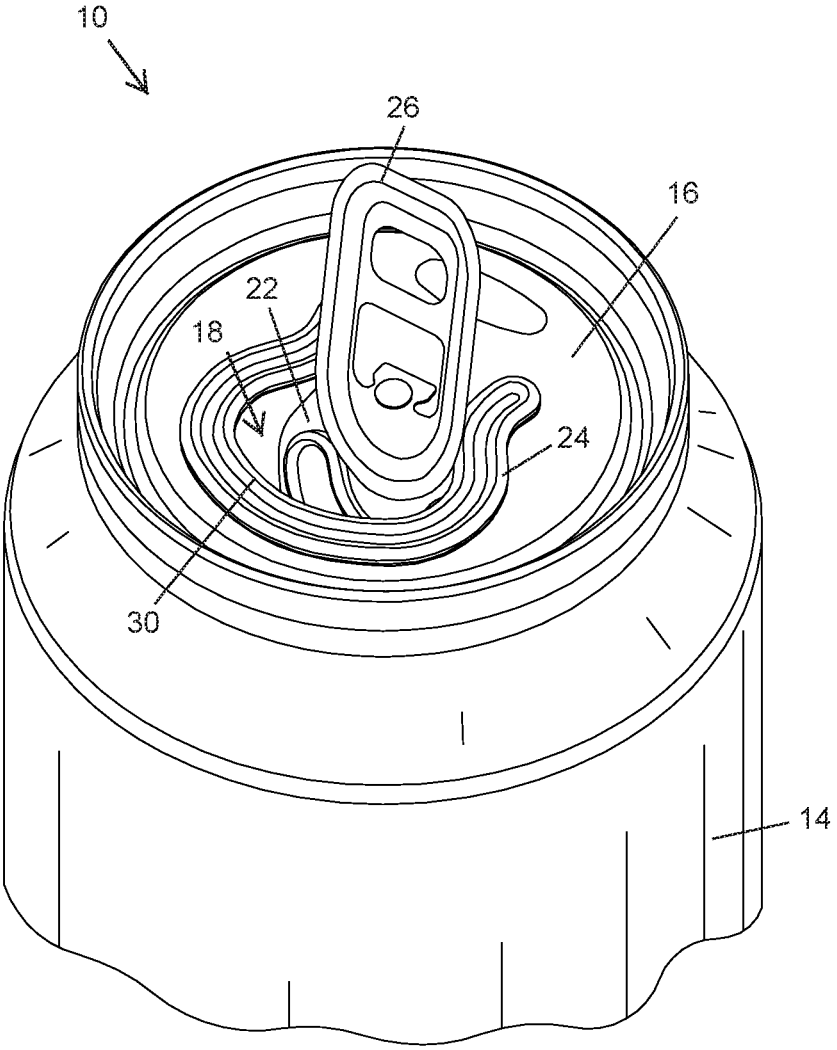
FIG. 6 is an expanded view of the beverage container shown in FIG. 1 with the top flap in an open condition.

With reference to the figures, there is shown a beverage container 10 having a closed bottom 12, continuous sidewall 14 and a top lid 16 defining an interior volume 18. As seen most clearly in FIG. 2, top lid 16 may include and arcuate channel 20 and a scored flap 22 in communication with arcuate channel 20. Arcuate seal member 24 may then be dimensioned to be received within arcuate channel 20 so as to seal top lid 16, and prevent loss of fluid from within interior volume 18. In accordance with an aspect of the present invention, arcuate seal member 24 may be fabricated from a flexible yet resilient material. Arcuate seal member 24 may be press fit or injection molded into arcuate channel 20 as will be described in greater detail below. A pull-tab 26 is mounted on top lid 16 proximate flap 22. Pull-tab 26 is adapted to pivotally engage flap 22 such that downward pressure against flap 22 causes flap 22 to fold at score line 28 and hinge into interior volume 18 to thereby provide access to the contents within interior volume 18 (see FIG. 6). In accordance with an aspect of the invention and as shown in FIG. 6, arcuate seal member 24 remains secured about open lip portion 30 of arcuate channel 20 after flap 22 has been pivotally opened.

Figure 5:
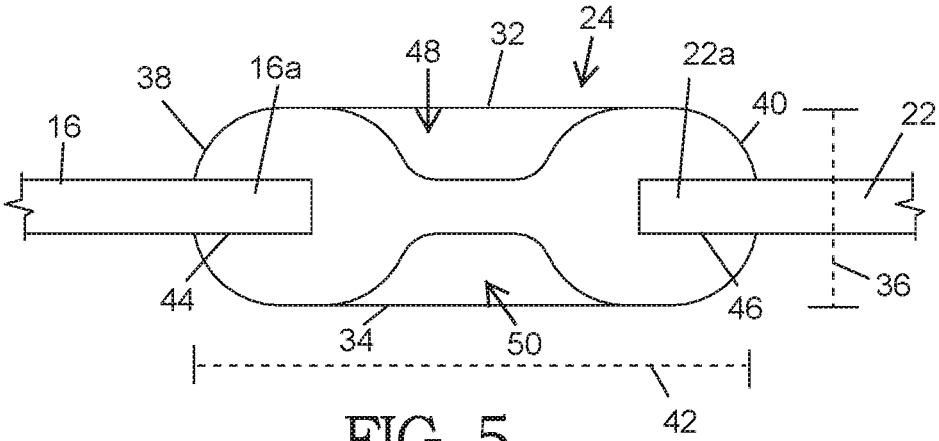
FIG. 5 is a cross section view of an embodiment of the safety seal taken generally along line 5-5 in FIG. 4.

As seen in the figures, arcuate seal member 24 may be generally C-shaped, and is best shown in FIG. 5, may include a top surface 32 and a bottom surface 34 defining a first thickness 36 therebetween. Opposing first edge 38 and second edge 40 may also define a first width 42. In accordance with an aspect of the present invention, first edge 38 may include a first channel 44 configured to receive a portion 16*a* of top lid 16 therein while second edge 40 includes a second channel 46 configured to receive a portion 22*a* of flap 22 therein. Thus, upon application of downward pressure from pull-tab 26, as described above, portion 22*a* of flap 22 is withdrawn from second channel 46 such that flap 22 can fold into interior volume 18 while portion 16*a* of top lid 16 remains encased within first channel 44. As a result, a user is not exposed to a sharp edge of the opening due to the presence of arcuate seal member 24. To assist flexibility and performance of arcuate seal member 24, one or both of top surface 32 and bottom surface 34 may include a respective furrow 48, 50 define therein.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A beverage container comprising:

a) a closed bottom, a continuous sidewall and a top lid, all defining a container interior volume, wherein the top lid includes an arcuate channel defined therein and a scored flap adjacent to the arcuate channel;

b) an arcuate seal member dimensioned to be received within the arcuate channel to thereby seal said container interior volume; and c) a pull-tab mounted on the top lid proximate the scored flap and adapted to engage the scored flap and create an open lip within the top lid to thereby provide access to the container interior volume, wherein the arcuate seal member is disposed on the open lip, and wherein the scored flap is removed from the arcuate seal member and pushed into the container interior volume.

2. The beverage container of claim 1 wherein the arcuate seal member is comprises a C-shaped open ring element and includes a top surface and a bottom surface defining a first thickness, and wherein said arcuate seal member includes a first edge and a second edge defining a first width.

3. The beverage container of claim 2 wherein the first edge defines a first channel configured to receive a portion of the top lid therein, and wherein the second edge defines a second channel configured to receive a portion of the scored flap therein.

4. The beverage container of claim 2 wherein at least one of the top surface and the bottom surface include a respective furrow defined therein.

5. The beverage container of claim 1 wherein the arcuate seal member comprises a resilient and flexible material.

* * * * *